US009033161B2

(12) United States Patent
Larson et al.

(10) Patent No.: US 9,033,161 B2
(45) Date of Patent: May 19, 2015

(54) WALL ORGANIZER

(71) Applicant: Target Brands, Inc., Minneapolis, MN (US)

(72) Inventors: Katherine E. Larson, Minneapolis, MN (US); Thomas P. Kuehn, St. Louis Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 70 days.

(21) Appl. No.: 14/018,812

(22) Filed: Sep. 5, 2013

(65) Prior Publication Data

US 2015/0060379 A1 Mar. 5, 2015

(51) Int. Cl.

*A47G 29/00* (2006.01)
*A47F 5/08* (2006.01)
*A47F 7/28* (2006.01)

(52) U.S. Cl.

CPC ..... *A47F 5/0884* (2013.01); *A47F 7/28* (2013.01)

(58) Field of Classification Search

CPC ..... A47G 29/00; A47G 29/087; A47G 29/10; A47G 25/74; A47G 25/746; A47G 25/0607; A47G 25/0614; A47G 25/0621; A47F 5/08; A47F 5/0876; A47F 5/0884; A47F 5/0838; A47F 5/0807; A47F 5/0006; A47F 7/12; A47F 7/005; A47F 7/022; A47F 7/143; A47B 73/00; A47B 73/008; A47K 10/12

USPC ..... 211/87.01, 70.01, 75, 70.6, DIG. 1, 211/88.04, 6, 16, 61, 67, 68, 70.7, 66, 211/119.009, 119.004, 85.2; 248/690, 248/225.11, 225.21, 316.8

See application file for complete search history.

(56) References Cited

U.S. PATENT DOCUMENTS

| | | | | | |
|---|---|---|---|---|---|
| 929,220 | A | * | 7/1909 | Hirsch | 211/70.7 |
| 1,069,711 | A | * | 8/1913 | MacDonald | 211/45 |
| 1,552,510 | A | * | 9/1925 | Scofield | 211/88.01 |
| 3,517,822 | A | | 6/1970 | Wagner | |
| 3,545,176 | A | * | 12/1970 | Wheelock | 53/390 |
| 3,744,665 | A | | 7/1973 | Spoto | |

(Continued)

FOREIGN PATENT DOCUMENTS

| | | |
|---|---|---|
| CN | 103142119 A | 6/2013 |
| GB | 494562 | 10/1938 |

OTHER PUBLICATIONS

Hall, May 19, 2010. Remodelista Daily: Pocket Strip Wall Organizer by Three by Three , p. 1-2, retrieved at http://www.remodelista.com/posts/storage-pocket-strip-wall-organizer.*

(Continued)

*Primary Examiner* — Daniel J Troy
*Assistant Examiner* — Kimberley S Wright
(74) *Attorney, Agent, or Firm* — Leanne Taveggia Farrell; Westman, Champlin & Koehler, P.A.

(57) ABSTRACT

A wall organizer includes a base having a main section that is mountable to a wall, a return section and a joined section coupling the main section to the return section. The return section extends upwardly from the joined section and terminates at a free end. Together the main section, the return section and the joined section define a pocket. The free end of the return section terminates at a plurality of different heights relative to a bottom of the joined section to form a plurality of spaced apart prongs.

16 Claims, 6 Drawing Sheets

(56) References Cited

U.S. PATENT DOCUMENTS

| | | | | | |
|---|---|---|---|---|---|
| 3,986,695 | A | | 10/1976 | Hronas | |
| D242,098 | S | | 11/1976 | Leopold | |
| D256,529 | S | * | 8/1980 | Van Koert | D6/570 |
| D297,693 | S | | 9/1988 | Norstedt | |
| 4,830,198 | A | * | 5/1989 | Colquitt | 211/70.6 |
| 4,984,693 | A | * | 1/1991 | Belokin et al. | 211/88.01 |
| D341,624 | S | | 11/1993 | Evenson et al. | |
| 5,337,906 | A | | 8/1994 | Digiulio | |
| 5,775,521 | A | | 7/1998 | Tisbo | |
| 5,806,692 | A | * | 9/1998 | Pepper | 211/88.01 |
| 5,880,713 | A | | 3/1999 | Belardinelli | |
| 5,934,637 | A | * | 8/1999 | Robinson | 248/311.2 |
| 6,003,694 | A | | 12/1999 | Sharp | |
| D426,999 | S | * | 6/2000 | Smith | D6/574 |
| D444,377 | S | | 7/2001 | Harvey | |
| 6,820,755 | B1 | | 11/2004 | Ranjit | |
| 7,014,158 | B2 | | 3/2006 | Berry | |
| 7,314,142 | B2 | | 1/2008 | Lyman, Jr. | |
| D585,494 | S | | 1/2009 | Yoshikawa | |
| D587,053 | S | * | 2/2009 | Goodman et al. | D19/90 |
| 7,641,056 | B2 | | 1/2010 | Schulman | |
| D616,687 | S | * | 6/2010 | Yuzyk | D6/553 |
| D639,594 | S | * | 6/2011 | Goodman et al. | D6/572 |
| D688,202 | S | * | 8/2013 | Mecca et al. | D13/108 |
| 2010/0038330 | A1 | * | 2/2010 | Zu | 211/90.04 |
| 2010/0314343 | A1 | | 12/2010 | O'Leary et al. | |
| 2010/0320160 | A1 | * | 12/2010 | Norris | 211/26 |
| 2012/0019208 | A1 | * | 1/2012 | Clouser | 320/115 |
| 2014/0285295 | A1 | * | 9/2014 | Liimatta | 335/285 |

OTHER PUBLICATIONS

Hoyo, Stainless Stee; Message Board, Mar. 26, 2012,p. 1, retrieved at http://sell.lulusoso.com/selling-leads/1237789/stainless-steel-magneti-board-Magnetic-memo-board-with-Key-rack-Message-Board-drawing-board-WoodenC.html.*

Spectrum 3-Tier Wall-Mount File Holder and Magazine Rack. Amazon.com, at least as early as May 11, 2010 [retrieved Dec. 11, 2013]. Retrieved from the internet, htttp://amazong.com/Spectrum-3-Tier-Wall-Mount-Holder-Magazine/dp/B001RLUMYK (4 pages).

Office Action from Canadian Patent Application No. 2,829,381, mailed Dec. 13, 2013 (4 pages).

Three by Three Triple HOOK-UP Strip. Remodelista, Feb. 9, 2010 [retrieved Dec. 11, 2013]. Retrieved from the internet, http://remodelista.com/products/three-by-three-triple-hook-up-strip (4 pages).

Entrance organizer—CITRIS. Animi Causa, May 16, 2010 [retrieved Dec. 11, 2013]. Retrieved from the internet: http://www.animicausa.com/shop/Best-sellers/Entrance-organizer-CITRUS/tpflypage.tpl.html (4 pages).

Bloombety, "Mail Organizer Wall Mount With Cool Design," http://bloombety.com/mail-organizer-wall-mount/mail-organizer-wall-mount-with-cool-design/#page, at least as early as Aug. 2013, 1 page.

HSN, "Wood Wall Pockets," http://www.hsn.com/products/ballard-designs-wood-wall-pockets-2-pockets/6828444, at least as early as Aug. 2013, 1 page.

Etsy, "Modern Wall Key Holder and Mail Organizer," http://www.etsy.com/ca/listing/108410063/modern-wall-key-holder-and-mail, at least as early as Aug. 2013, 1 page.

Remodelista, "Pocket Strip Wall Organizer," http://www.remodelista.com/posts/storage-pocket-strip-wall-organizer, at least as early as Aug. 2013, 1 page.

Office Action from Canadian Patent Application No. 2,829,381, mailed Aug. 7, 2014 (4 pages).

Office Action from Canadian Patent Application No. 2,829,381, mailed Apr. 16, 2014 (4 pages).

* cited by examiner

WALL ORGANIZER

BACKGROUND

Wall organizers provide a space to store and organize belongings so that the belongings can be easily deposited and accessed. Wall organizers can be placed in areas, such as entryways, kitchens, offices and etc., and hold various items, such as pens, pencils, notepaper, mail, keys and etc. Some wall organizers are specific to holding office supplies and are located adjacent a desk, while other wall organizers are specific to holding belongings that would otherwise clutter spaces designed for other uses, like a kitchen and an entryway.

The discussion above is merely provided for general background information and is not intended to be used as an aid in determining the scope of the claimed subject matter.

SUMMARY

A wall organizer includes a base having a main section that is mountable to a wall, a return section and a joined section coupling the main section to the return section. The return section extends upwardly from the joined section and terminates at a free end. Together the main section, the return section and the joined section define a pocket. The free end of the return section terminates at a plurality of different heights relative to a bottom of the joined section to form a plurality of spaced apart prongs.

In another embodiment, a wall organizer includes a wall-mounting portion, an accessory support portion and an arcuate portion coupling the wall-mounting portion to the accessory support portion. The accessory support portion extends from the arcuate portion in an up-turned orientation relative to a bottom of the arcuate portion, and together the wall-mounting portion, the arcuate portion and the accessory support portion define a receptacle. The accessory support portion includes a plurality of projections and a plurality of valleys that define a terminating end of the accessory support portion. Each of the plurality of projections being spaced apart from each other by one of the valleys.

A method of assembling a wall organizer includes mounting the main section of the base to a wall. The method further includes coupling at least one accessory to at least one of the projections.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

As will be described in detail below, a wall organizer has base to which various types of accessories can be coupled in a variety of different configurations. The base has a wall-mounting portion, an accessory support portion and a portion joining the wall-mounting portion to the accessory support portion. Together, the wall-mounting portion, the accessory support portion and the portion joining the wall-mounting portion to the accessory support portion form a pocket. Further, the portion joining the wall-mounting portion is rounded so that the accessory support portion extends upwardly from the bottom of the portion that joins the wall-mounting portion to the accessory support portion.

Still further, the accessory support portion includes a free end that defines a plurality of prongs. Each prong is spaced apart from adjacent prongs by a valley to form a wavy free end. Accessories can be coupled to the prongs of the free end of the accessory support portion in various configurations that are useful to the user of the wall organizer.

Figure 1:
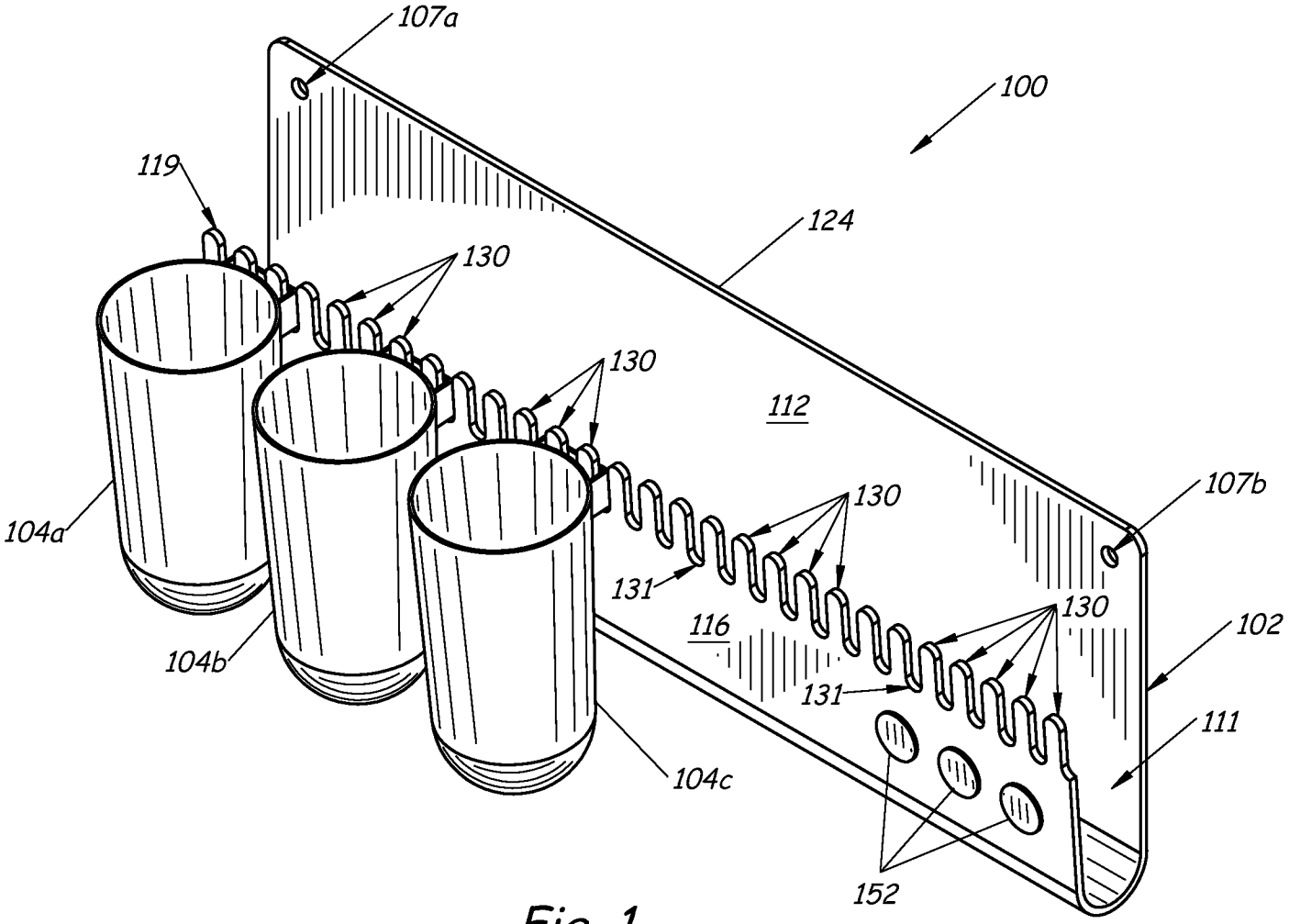
FIG. 1 is a perspective view of a wall organizer according to one embodiment.

FIG. 1 is a perspective view of a wall organizer 100 according to one embodiment. A front view, a top view, a left side view, a back view, a bottom view and a right side view are illustrated in FIGS. 2-7. Wall organizer 100 includes a base 102, which is separately shown in a front perspective view in FIG. 8 and in a side view in FIG. 9. Wall organizer 100 also includes a plurality of various accessories, such as a plurality of holders 104, that are coupled to base 102.

In one embodiment, base 102 is formed of a single, continuous material, such as sheet metal or plastic, and includes a main section or wall-mounting portion 106 and a return section or an accessory support portion 108 that is coupled to main section 108 by a joined section or arcuate portion 110. Main section 106 is substantially planar and substantially vertical. Main section 106 is mountable to a wall using apertures 107*a* and 107*b*. Apertures 107*a* and 107*b* are configured to receive wall-mounting fasteners (not illustrated). Main section 106 includes a front facing surface 112 and a back facing surface 114 that is opposite front facing surface 112.

Return section 108 is configured to support the various accessories and, like main section 106, is substantially planar. Return section 108 extends from joined section 110 and terminates at a free end or terminating end 119. Return section 108 includes a front facing surface 116 and a back facing surface (hidden from view) that is opposite front facing surface 116.

Joined section or arcuate portion 110 is arcuate or rounded in shape and extends from main section 106 to connect to return section 108. Due to the arcuate nature of joined section 110, return section 108 extends upwardly from a bottom 109 of joined section 110 or oriented in a generally up-turned or upward manner from bottom 109 of joined section 110. Main section 106 also includes a free end 124 that is located a height 126 (FIG. 9) relative to bottom 109 of joined section 110.

Figure 4:
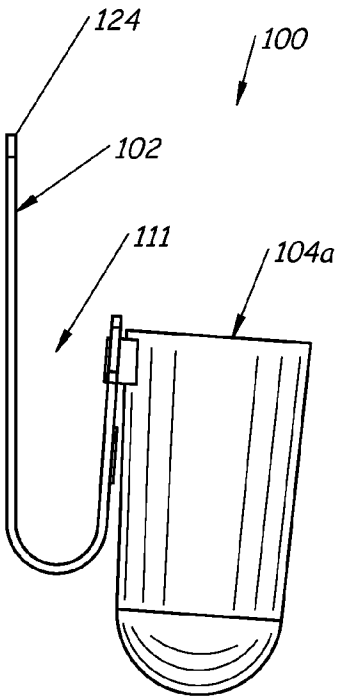
FIG. 4 is a left side view of the wall organizer illustrated in FIG. 1.
Figure 2:
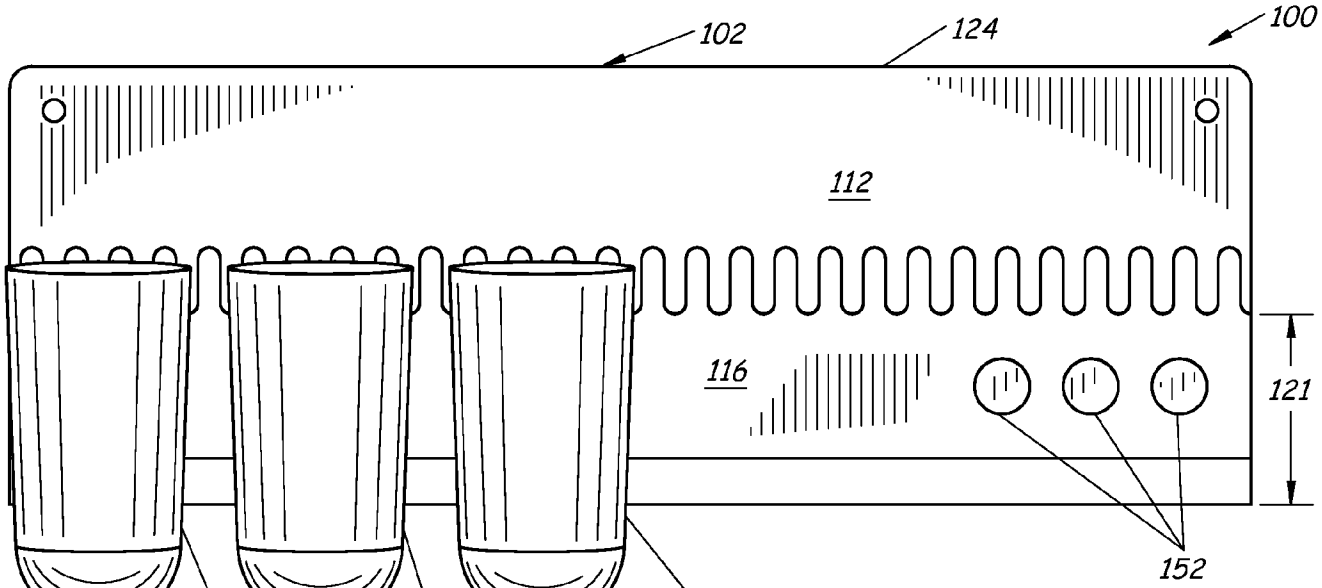
FIG. 2 is a front view of the wall organizer illustrated in FIG. 1.
Figure 7:
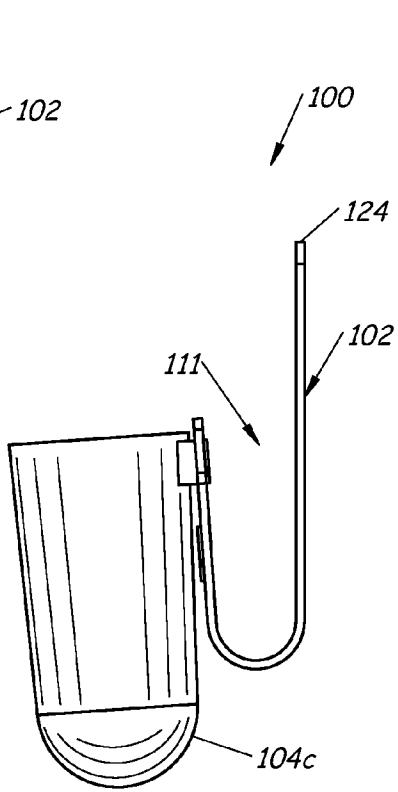
FIG. 7 is a right side view of the wall organizer illustrated in FIG. 1.
Figure 5:
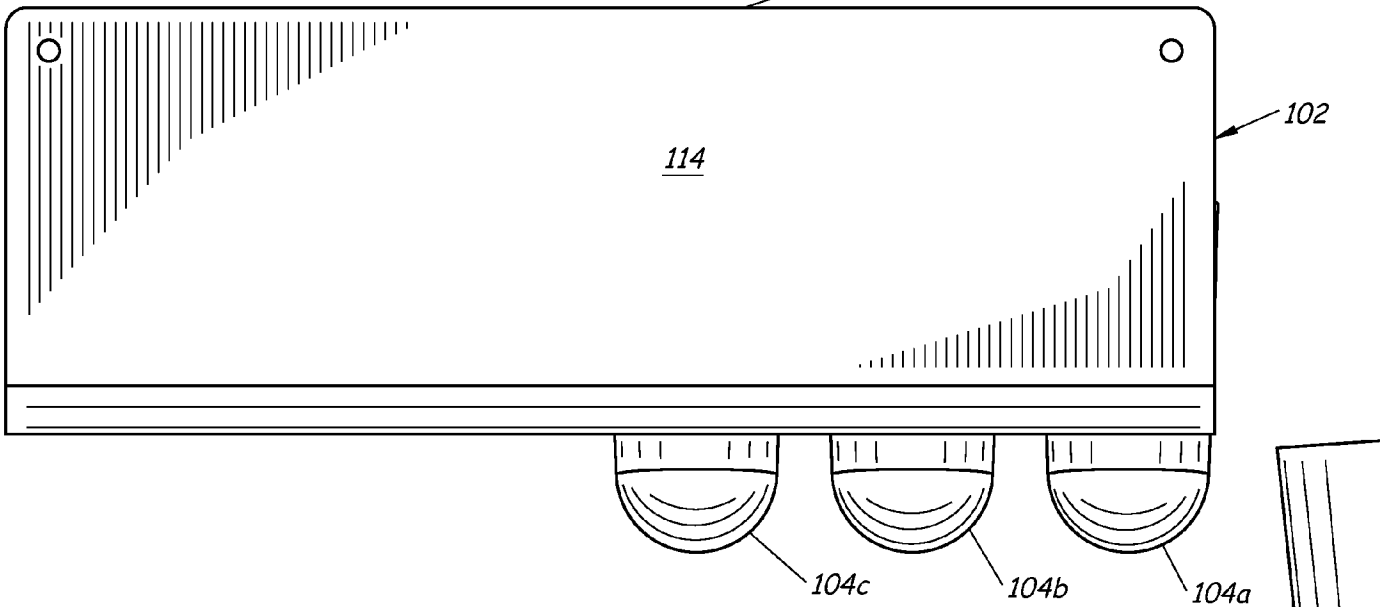
FIG. 5 is a back view of the wall organizer illustrated in FIG. 1.
Figure 6:
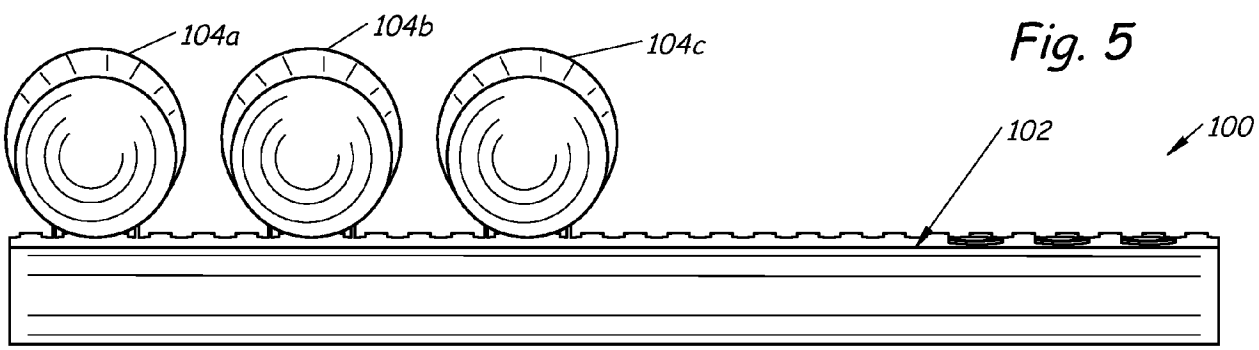
FIG. 6 is a bottom view of the wall organizer illustrated in FIG. 1.
Figure 9:
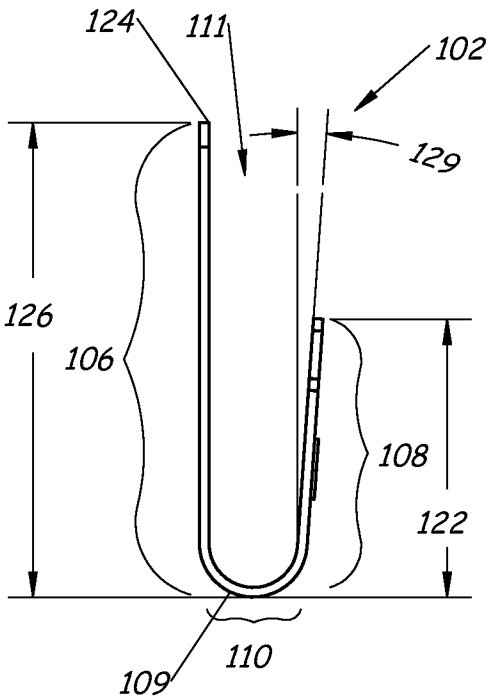
FIG. 9 is a side view of the base of the wall organizer illustrated in FIGS. 1-7.

Together main section 106, return section 108 and joined section 110 define a pocket or receptacle 111. While pocket or receptacle 111 includes a front that is provided by return section 108 and a back that is provided by main section 106, pocket or receptacle 111 includes, in one embodiment, open sides. Pocket 111 is configured to receive and support a user's items or belongings, such as items made of sheet material including mail, envelopes, paper, cards, note pads, photographs, and etc. As illustrated in FIGS. 4, 7 and 9, return section 108 is oriented at an angle 129 (FIG. 9) from the substantially vertical main section 106. The angle 129 at which return section 108 is oriented relative to the substantially vertical main section 106 places the free end 119 of return section 108 forward of joined section 110. By placing free end 119 forward of joined section 110, items stored in pocket or receptacle 111 are easier to access and, at the same time, easier to deposit into pocket or receptacle 111. Further features of wall organizer 100 that are related to angle 129 and placement of free end 119 of return section 108 forward of joined section 110 will be discussed in detail below.

Return section 108 includes a plurality of integrally formed prongs or projections 130 and a plurality of integrally formed valleys 131. Together the plurality of projections 130 and the plurality of valleys 131 define a free end or terminating end 119 of return section 108. Each prong or projection 130 is defined by a distal end 120, a first longitudinal side 132 and a second longitudinal side 134. In addition and in one embodiment, each prong or projection 130 is located along the same plane as the remainder of return section 108. Such a plane is also oriented at angle 129 relative to substantially vertical main section 106. Except for the valleys 131*a* and 131*b* that are located at the side ends of free end 119, each valley 131 connects a first longitudinal side 132 of a projection 130 to a second longitudinal side 134 of adjacent projections 130.

Figure 8:
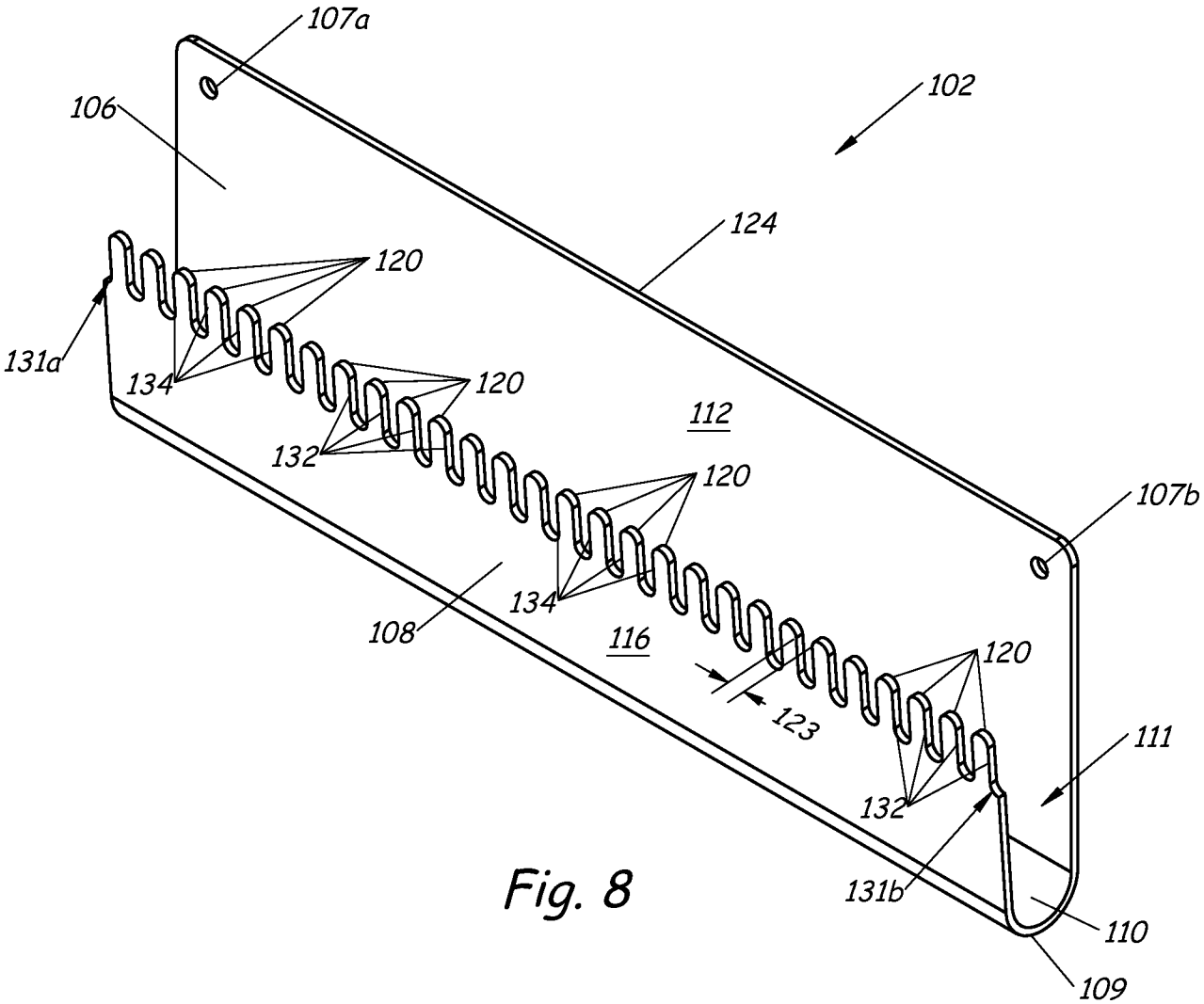
FIG. 8 is a front perspective view of the base of the wall organizer illustrated in FIGS. 1-7.

In one embodiment and as illustrated in the figures, first longitudinal side 132 and second longitudinal side 134 are substantially parallel to each other and distal end 120 connects first longitudinal side 132 to second longitudinal side 134. Each of the plurality of prongs or projections 130 is spaced apart from an adjacent prong or projection 130 by one of the valleys 131. In one embodiment and as illustrated in FIG. 8, each prong or projection 130 is spaced apart from each other by a distance 123, which is the width of each valley 131.

Due to projections 130 and valleys 131, free end 119 of return section 108 varies in height relative to bottom 109 of jointed section 110. For example, free end 119 terminates at a minimum height 121 relative to bottom 109. In one embodiment and as illustrated in FIG. 9, minimum height 121 is the height of the plurality of valleys 131 relative to bottom 109 of joined section 110. In another example, free end 119 terminates at a maximum height 122 relative to bottom 109. In one embodiment and as illustrated in FIG. 9, maximum height 122 is the height of distal ends 120 of the plurality of projections 130. Although the embodiment illustrated in the figures includes distal ends 120 of projections 130 that are all at the same height and includes valleys 121 that are all at the same height, in alternative embodiments, each distal end 120 of each projection 130 may not all terminate at the same height 122 and each valley 131 may not terminate at the same height 121. Rather, distal ends 120 may terminate at different, varying heights and valleys 121 may terminate at different, varying heights. Regardless, the maximum height 122 of distal ends 120 does not exceed height 126 of main section 106. In other words, height 122 is less than height 126.

In one embodiment and as illustrated in the figures, distal ends 120 of projections 130 are rounded and valleys 131 that connect the first longitudinal sides 132 of each prong 130 to the second longitudinal sides 134 of each adjacent prong are rounded. In this way, free end 119 of return section 108 appears to be wavy. However, it should be realized that other shapes are possible. For example, in one embodiment distal ends 120 of projections 130 can be squared and valleys 131 can be squared. In another embodiment, distal ends 120 of projections 130 can be rounded and valleys 131 can be squared. In still another embodiment, distal ends 120 of projections 130 can be rounded and valleys 131 can be squared.

Figure 11:
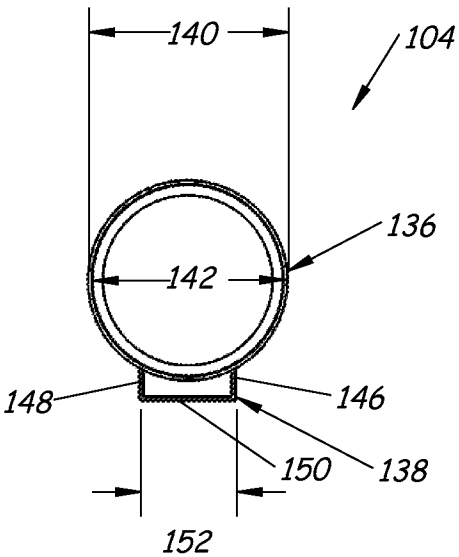
FIG. 11 illustrates a top view of one of the cups of the wall organizer illustrated in FIGS. 1-7.
Figure 10:
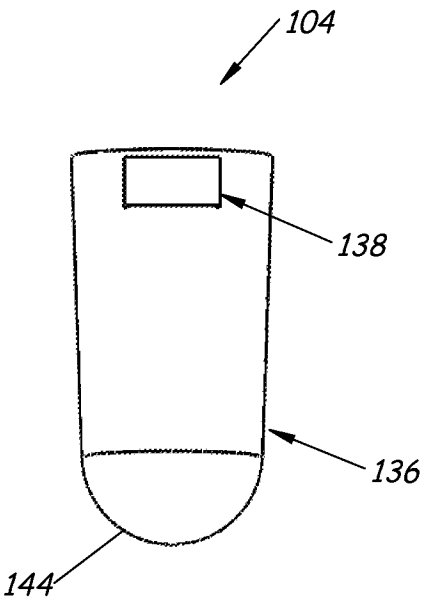
FIG. 10 is a back view of one of the cups of the wall organizer illustrated in FIGS. 1-7.

Prongs 130 are configured to support holders 104 for holding items or belongings of a user. For example, holders 104 are configured to receive and support various utensils including pens, pencils, markers, scissors, letter openers, etc. FIG. 10 illustrates a back view of one of the plurality of holders 104. FIG. 11 illustrates a top view of the holder 104 illustrated in FIG. 10. As illustrated in FIGS. 10 and 11, holder 104 is made of a single, continuous material, such as sheet metal or plastic, and includes a cup 136 and a hook 138. Each cup 136 of holder 104 is in the shape of a cylinder, which has an outer diameter 140, an inner diameter 142 and a curved or rounded bottom 144. Integrally coupled to the back of each cup 136 is hook 138. Hook 138 includes a first leg 146, a second leg 148 and a cross member 150 connecting first leg 146 to second leg 148. First leg 146 and second leg 148 are spaced apart from each other by a distance 152.

Figure 3:
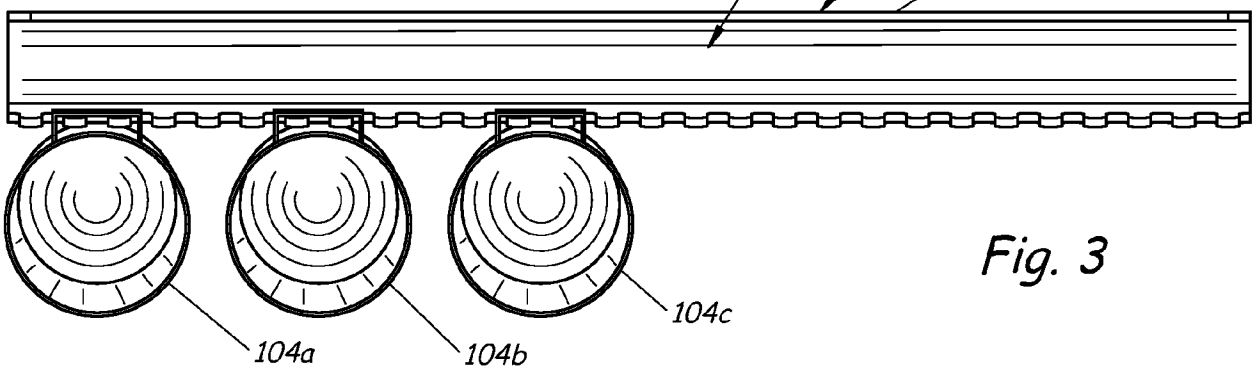
FIG. 3 is a top view of the wall organizer illustrated in FIG. 1.

In one embodiment and as illustrated in FIGS. 1 and 3, distance 152 is sized so that hook 138 can fit over, circumnavigate or otherwise surround two of the prongs or projections 130 of return section 108 such that holder 104 can be coupled or otherwise hung from prongs 130. However, distance 152, and therefore also outer and inner diameters 140 and 142 of cup 136 can be sized so that hook 138 can fit over any number of prongs or loops 130. For example, hook 138 can circumnavigate one, three or even four prongs 130. The greater amount of prongs 130 that hook 138 circumnavigates provides a greater amount of support to the utensils or items being held within cup 126 of holder 104. In addition, valleys 131 and longitudinal sides 132 and 134 located on each side of the at least one projection that hook 138 circumnavigates engages with hook 138 to provide additional support to cup 136. In this way, prongs or projections 130 provide holder 104 with longitudinal support, valleys 131 provide holder 104 with lateral support and longitudinal sides of adjacent prongs that are not circumnavigated by hook 138 provide holder 104 with lateral support.

As illustrated in FIGS. 1-3 and 5-6, terminating end 109 of return section 108 includes twenty-eight prongs or projections 130 and twenty-nine valleys 131. However, terminating end 119 of return section 108 can include any number of prongs or projections 130. As illustrated in FIGS. 1-7, a first holder 104*a* is hung from prongs 130 that are the second and third prongs from the left of return section 108. A second holder 104*b* is hung from prongs 130 that are the seventh and eighth prongs from the left of return section 108. A third holder 104*c* is hung from prongs 130 that are the twelfth and thirteenth prongs 130 from the left of return section 108. It should be realized, however, that first holder 104*a*, second holder 104*b* and third holder 104*c* can be user configured to hang from any two or at least one of the twenty-eight prongs 130 including separating holders 104*a*, 104*b*, 104*c* by more than three prongs as is shown in FIGS. 1-3 and 5-6 and including coupling only one or two of the holders 104*a*, 104*b* and 104*c* rather than all three of the holders.

As illustrated in FIG. 4, since return section 108 is oriented at angle 129 from the substantially vertical main section 106, holders 104*a*, 104*b* and 104*c* are also oriented at angle 129 from the substantially vertical main section 106. In this way, cups 136 of holders 104*a*, 104*b* and 104*c* are slightly angled toward a user and away from the wall to provide easier access to and deposit of the various items that holders 104*a*, 104*b* and 104*c* can support.

In addition to wall organizer 100 including base 102 and holders 104*a* 104*b* and 104*c*, wall organizer 100 also includes a plurality of magnets 152. Even though magnets 152 are illustrated as being magnetically attached to front facing surface 116 of return section 108, magnets 152 can be magnetically attached to any surface on base 102 of wall organizer 100 including front facing surface 112 of main section 106. In addition, while magnets 152 are illustrated as being round magnetic pieces, magnets 152 can take on any type of shape.

Figure 12:
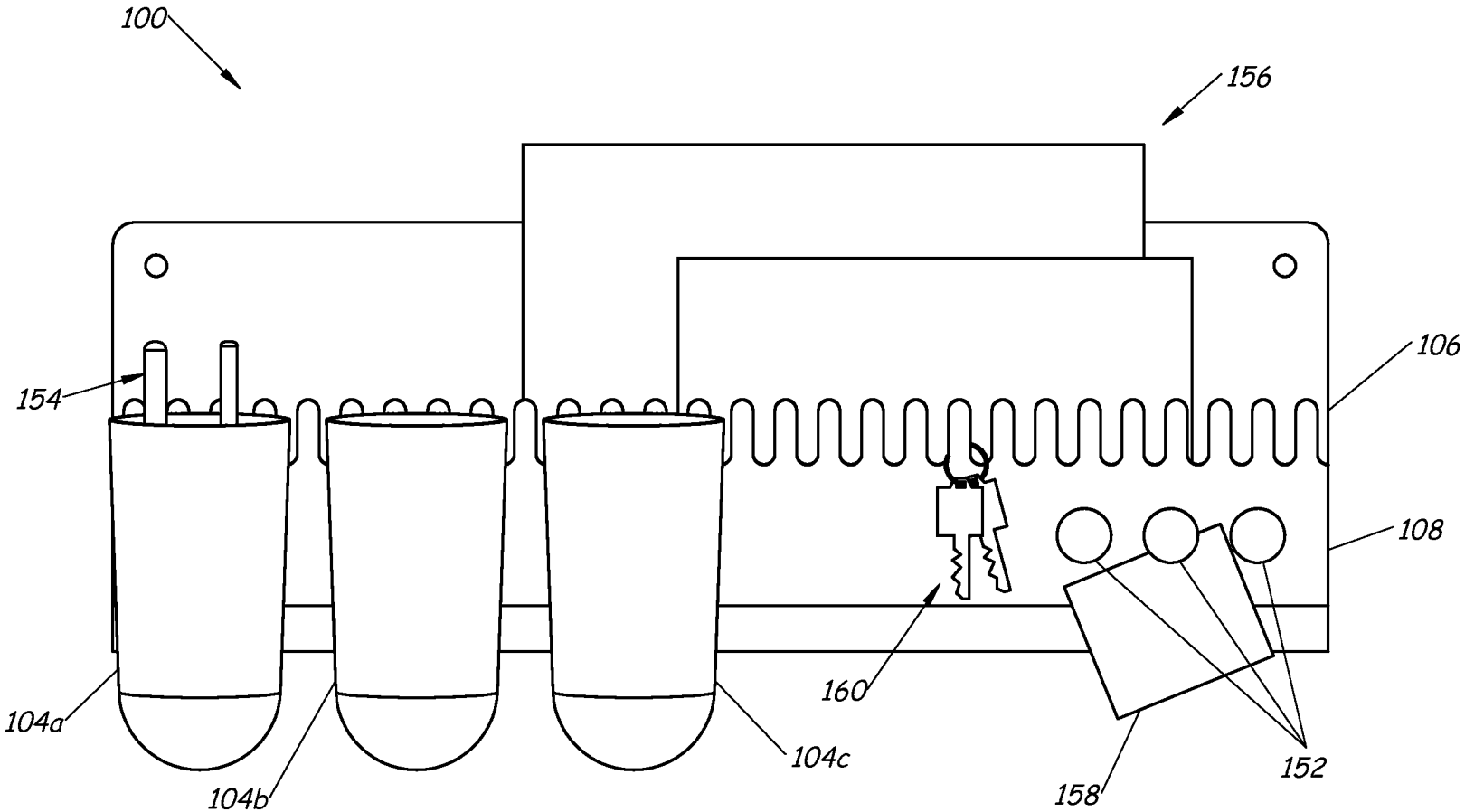
FIG. 12 illustrates a front view of the wall organizer illustrated in FIGS. 1-7 supporting various accessories and items.

FIG. 12 illustrates a front view of wall organizer 100 in use. As illustrated, holder 104*a* is supporting various items or utensils 154, such as pens and pencils. Although FIG. 12 only illustrates holder 104*a* holding items or utensils, holders 104*b* and 104*c* are also configured to hold items or utensils. Furthermore, pieces of sheet material 156 are being supported in pocket 111, such as mail. Still further, one of the magnets 152 is supporting a reminder note 158 by holding note 158 between magnet 152 and return section 108 of base 102. Since the reminder note 158 is supported by one of the magnets 152 that is coupled to front facing surface 116 of return section 108 the reminder note 158 is therefore brought forward to the attention of the user rather than being partially hidden in pocket 111 behind return section 108. Magnets 152 can support other loose items for the user including photographs and coupons. Still further, prongs 130 that are free of being used to support holders 104 can be used to support loose items. For example and as illustrated in FIG. 12, one of the prongs can support a ring that is holding a set of keys 160. Other exemplary loose items that prongs 130 can be used to support besides holders 104*a*, 104*b* and 104*c* include lanyards, wristlets dog leashes, etc.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A wall organizer comprising:

a base including a main section that is mountable to a wall, a return section and a joined section coupling the main section to the return section, wherein the return section extends upwardly from the joined section and terminates at a free end, the main section, the return section and the joined section defining a pocket; and a plurality of holders coupled to the free end of the return section, each holder including a cup configured to hold items and a hook supporting the cup on the return section; and wherein the free end of the return section defines a plurality of spaced apart prongs, each prong including a distal end, a front longitudinal side and a second longitudinal side.

2. The wall organizer of claim 1, wherein the main section is planar and is oriented substantially vertical and the return section is planar and is oriented at an angle relative to the substantially vertical main section.

3. The wall organizer of claim 2, wherein the angle at which the return section is oriented relative to the substantially vertical main section places the free end of the return section forward of the joined section.

4. The wall organizer of claim 1, wherein the hook supports the cup on the return section by circumnavigating at least one of the prongs.

5. The wall organizer of claim 1, further comprising at least one magnet magnetically coupled to one of a front facing surface of the main section and a front facing surface of the return section.

6. The wall organizer of claim 1, wherein the pocket comprises open sides.

7. A wall organizer comprising:

a wall-mounting portion, an accessory support portion and an arcuate portion coupling the wall-mounting portion to the accessory support portion, wherein the accessory support portion extends from the arcuate portion in an up-turned orientation relative to a bottom of the arcuate portion and wherein the wall-mounting portion, the arcuate portion and the accessory support portion define a receptacle; and a plurality of cups, wherein each cup is coupled to the accessory support portion by a hook; and wherein the accessory support portion includes a plurality of projections and a plurality of valleys that together define a terminating end of the accessory support portion, each of the plurality of projections being spaced apart from each other by one of the valleys.

8. The wall organizer of claim 7, wherein the wall-mounting portion comprises a height and the accessory support portion comprises a plurality of different heights, the different heights of the accessory support portion being less than the height of the wall-mounting portion.

9. The wall organizer of claim 7, wherein the receptacle comprises open sides.

10. The wall organizer of claim 7, wherein the wall-mounting portion is planar and oriented substantially vertical and wherein the accessory support portion is planar and oriented at an angle relative to the substantially vertical wall-mounting portion.

11. The wall organizer of claim 10, wherein the angle at which the accessory support portion is oriented relative to the substantially vertical wall-mounting portion places the terminating end of the accessory support portion forward of the arcuate portion.

12. The wall organizer of claim 7, wherein the hook supports the cup on the accessory support portion by circumnavigating at least one of the projections and engaging with the valleys located on each side of the at least one projection.

13. The wall organizer of claim 7, further comprising at least one magnet that is magnetically coupled to one of a front facing surface of the wall-mounting portion and a front facing surface of the accessory support portion.

14. A method of assembling a wall organizer, the method comprising:

mounting a main section of a base to a wall, the base including a return section and a joined section coupling the main section to the return section, wherein the return section extends upwardly from the joined section and terminates at a free end to define a receptacle and wherein the return section includes a plurality of projections and a plurality of valleys, each of the plurality of projections being spaced apart from each other by one of the valleys and together the plurality of projections and the plurality of valleys define a terminating end of the return section; and coupling at least one accessory to at least one of the projections, the at least one accessory including a cup and a hook supporting the cup on the return section.

15. The method of claim 14, wherein coupling the at least one accessory to the at least one projection comprises circumnavigating the at least one projection with the hook located on the at least one accessory.

16. The method of claim 14, further comprising magnetically coupling at least one magnet to a front facing surface of the return section.

* * * * *